US005509163A

United States Patent [19]

Morad

[11] Patent Number: 5,509,163

[45] Date of Patent: Apr. 23, 1996

[54] QUICK SQUEEZING WRINGABLE MOP

[75] Inventor: Fred I. Morad, Toluca Lake, Calif.

[73] Assignee: Worldwide Integrated Resources, Inc., Glendale, Calif.

[21] Appl. No.: 412,997

[22] Filed: Mar. 29, 1995

[51] Int. Cl.[6] ..... A47L 13/142

[52] U.S. Cl. ..... 15/120.2; 15/120.1; 15/229.1

[58] Field of Search ..... 15/120.1, 120.2, 15/228, 229.1

[56] References Cited

U.S. PATENT DOCUMENTS

| | | | |
|---|---|---|---|
| 1,126,887 | 2/1915 | Scott . | |
| 1,475,083 | 11/1923 | Portner . | |
| 1,494,871 | 5/1924 | Watkins et al. . | |
| 1,514,051 | 11/1924 | Jumonville | 15/120.2 |
| 1,520,500 | 12/1924 | Jumonville | 15/120.2 |
| 1,924,817 | 8/1933 | Tatter . | |
| 1,937,141 | 11/1933 | Carlson . | |
| 2,042,892 | 6/1936 | Granger . | |
| 2,185,502 | 1/1940 | Fatland . | |
| 2,230,101 | 1/1941 | Bakemeier . | |
| 2,495,846 | 1/1950 | Johnson . | |
| 3,278,977 | 10/1966 | Maker . | |
| 3,334,369 | 8/1967 | Maker . | |
| 4,178,650 | 12/1979 | Aasland . | |
| 4,479,278 | 10/1984 | Heinonen | 15/120.2 |

*Primary Examiner*—Edward L. Roberts, Jr.
*Attorney, Agent, or Firm*—Thomas I. Rozsa; Tony D. Chen

[57] ABSTRACT

A quick squeezing self-wringing mop which utilizes an outer tubular member for wringing the mop dry. It comprises an outer tubular member, an inner shaft located within the outer tubular member and which is movable longitudinally relative to the inner shaft and rotatable relative thereto, a locking body, a mop, a spring-and-ratchet mechanism, and a handle member. The spring-and-ratchet mechanism comprises a pawl which is pivotally mounted to the outer tubular member. The pawl is biased by a spring such that its tip is engaged with one of the multiplicity of longitudinal ribs on the inner shaft to prevent the outer tubular member from rotating back to its initial position. When the outer tubular member is rotated in its clockwise circular path, which squeezes the mop, the outer tubular member can stop at any position relative the inner shaft and have the outer tubular member released, without causing the mop to unwind. The pawl is pressed against the spring to disengage it from the ribs of the inner shaft to unlock the rotational movement of the outer tube member, thereby allowing the outer tubular member to automatically and rapidly spring back to its initial position and unwind the mop for use.

18 Claims, 2 Drawing Sheets

FIG.1
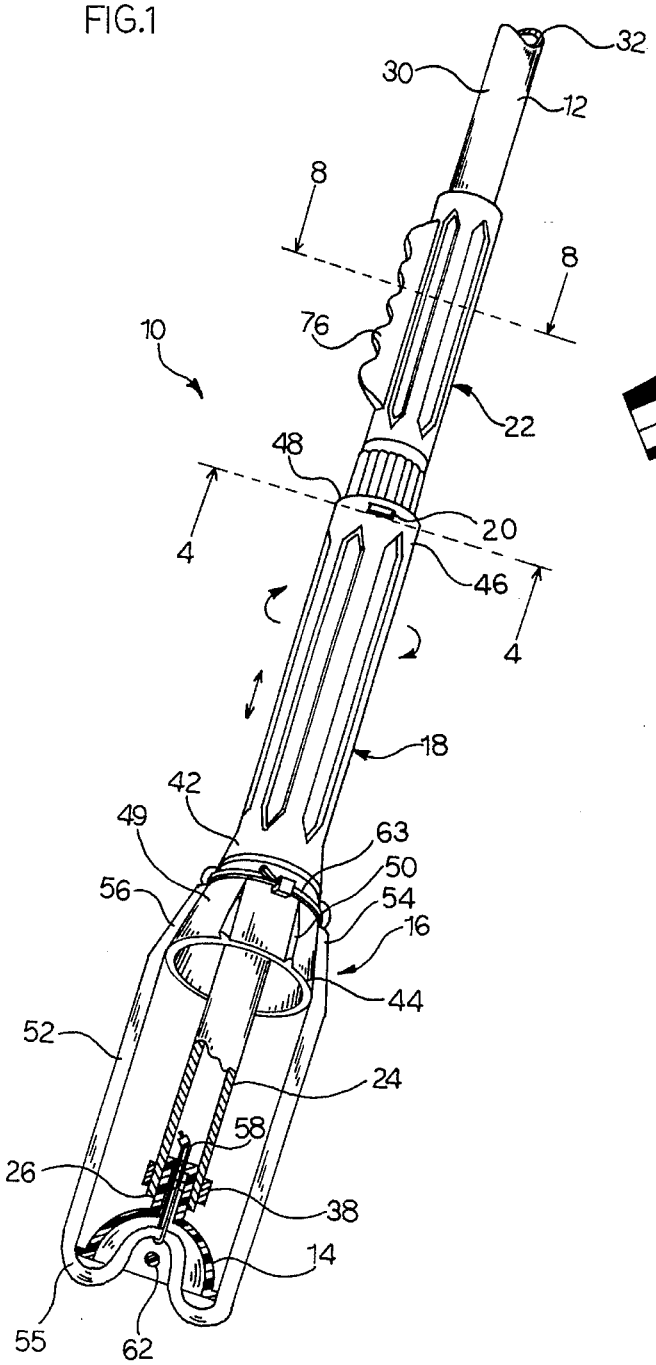
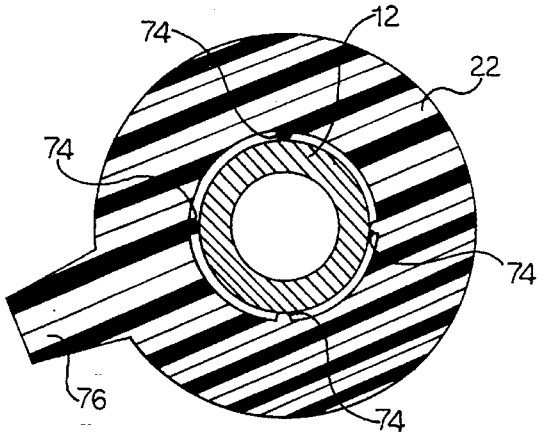
FIG.8
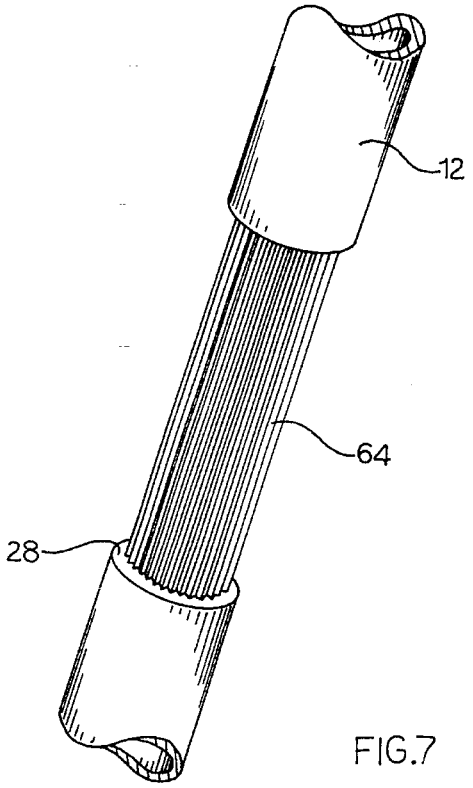
FIG.7

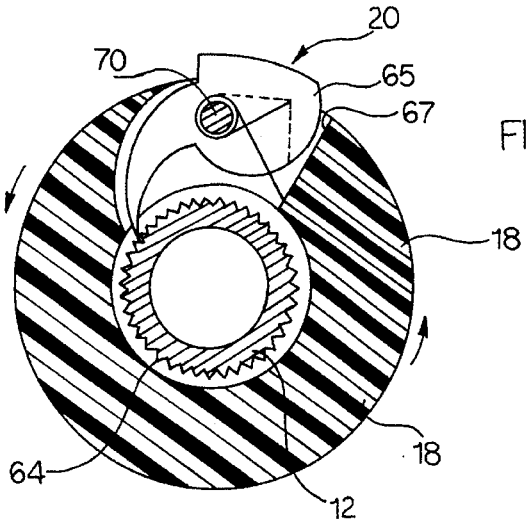
FIG.4
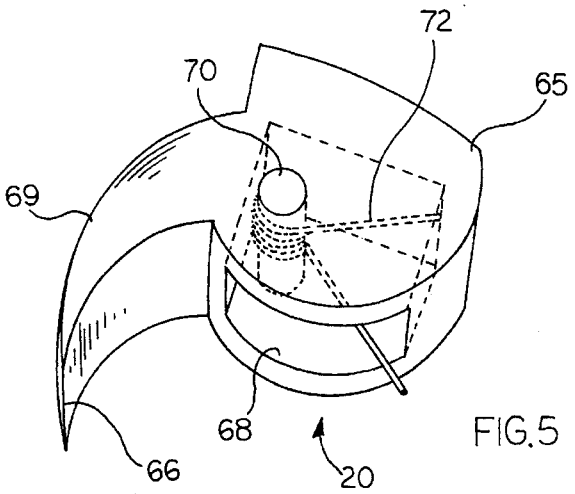
FIG.5
FIG.2
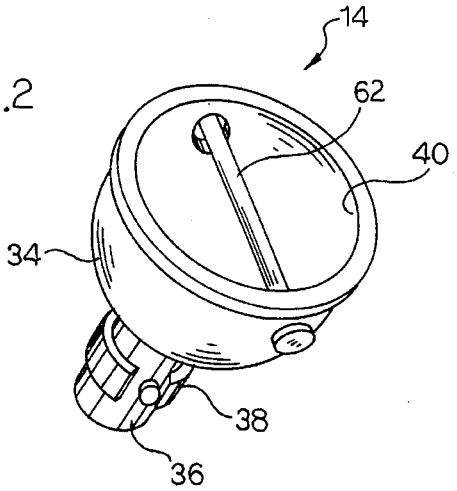
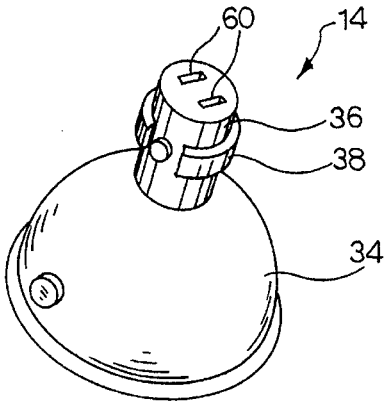
FIG.3
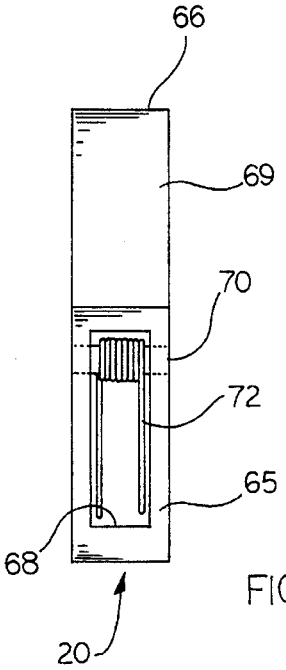
FIG.6

QUICK SQUEEZING WRINGABLE MOP

BACKGROUND OF THE INVENTION

1. Field of the Invention

The present invention relates to the field of mop wringers. More particularly, the present invention relates to the field of hand-operated self-wringing mops.

2. Description of the Prior Art

Generally, self-wringing mops are currently being used in general households and ordinary businesses or institutions. These prior art mops are hand-operated. One of the disadvantages is that the effectiveness of the prior art self-wringing mops depends on the strength of the user. To drain the mop more effectively, the user needs to rotate the wringer handle firmly. In other words, how firmly the wringer handle is rotated depends on how hard the user rotates the wringer handle to squeeze the water out from the mop. A user with less strength often has to repeat the operation several times to drain the mop as desired. Another disadvantage with prior art self-wringing mops is that once the wringer handle is rotated to a position where the water is squeezed out from the mop, and if the user releases the wringer handle, the mop tends to unwind by itself and will return to its initial position. The user will often need to rotate the wringer handle repeatedly to drain the mop as desired.

These drawbacks of the prior art self-wringing mops are very undesirable for people with less physical strength, especially elderly people. Even for people with normal strength, the awkward and laborious operation of repeatedly rotating the wringer handle to squeeze the water out from the mop increases their fatigue very rapidly.

The following thirteen (13) prior art patents were uncovered in the pertinent field of the present invention:

1. U.S. Pat. No. 1,126,887 issued to Scott on Feb. 2, 1915 for "Self Wringing Mop" (hereafter "the Scott Patent");

2. U.S. Pat. No. 1,475,083 issued to Portner on Nov. 20, 1923 for "Mop Wringer" (hereafter "the Portner Patent");

3. U.S. Pat. No. 1,494,871 issued to Watkins et al. on May 20, 1924 for "Mop And Wringer" (hereafter "the Watkins Patent");

4. U.S. Pat. No. 1,924,817 issued to Tatter on Aug. 29, 1933 for "Combined Mop And Mop Wringer" (hereafter "the Tatter Patent");

5. U.S. Pat. No. 1,937,141 issued to Carlson on Nov. 28, 1933 for "Mop" (hereafter "the Carlson Patent");

6. U.S. Pat. No. 2,185,502 issued to Fatland on Jan. 2, 1940 for "Wringer Mop" (hereafter "the Fatland Patent");

7. U.S. Pat. No. 2,042,892 issued to Granger on Jun. 2, 1936 for "Mop" (hereafter "the Granger Patent");

8. U.S. Pat. No. 2,230,101 issued to Bakemeier on Jan. 28, 1941 for "Mop Holder And Wringer" (hereafter "the Bakemeier Patent");

9. U.S. Pat. No. 2,495,846 issued to Johnson on Jan. 31, 1950 for "Combined Mop And Wringer Head" (hereafter "the Johnson Patent");

10. U.S. Pat. No. 3,278,977 issued to Makar on Oct. 18, 1966 for "Automobile Washing Mop Employing Twistable Mop Head" (hereafter "the '977 Maker Patent");

11. U.S. Pat. No. 3,334,369 issued to Makar on Aug. 8, 1967 for "Self-Wringing Mop" (hereafter "the '369 Maker Patent");

12. U.S. Pat. No. 4,178,650 issued to Aasland on Dec. 18, 1979 for "Self-Wringing Mop" (hereafter "the Aasland Patent");

13. U.S. Pat. No. 4,479,278 issued to Heinonen on Oct. 30, 1984 for "Scrubbing Means" (hereafter "the Heinonen Patent").

The Watkins Patent discloses a mop and wringer. It comprises a handle and a collar loosely mounted upon the handle. The collar comprises a strand holding device for holding strands from the mop and a grip portion for facilitating movement of the collar in the longitudinal direction.

The Tatter Patent discloses a combined mop and mop wringer. It comprises two housing portions wherein each housing portion has a spherical seat which forms a bearing seat for the spherical surface on each of the gears. The gears are located on opposite sides of the pinion gear which mesh and operate by means of the gear teeth on the pinion gear and the gear teeth on the gears.

The Carlson Patent discloses a mop. It comprises a handle and a sleeve-like head mounted on the handle for longitudinal sliding and rotating movements. A swab-holding clamp has a pair of relatively fixed arms and releasibly secured diametrically opposite radial arms on the head. A pair of cooperating relatively movable spring arms are hingeably connected to one of the fixed arms and releasibly secured to the other of the fixed arms with the handle extending therebetween.

The Fatland Patent discloses a wringer mop. It comprises a handle, a head, a cloth and a rod for wringing the cloth.

The Granger Patent discloses a mop. It comprises a hollow elongated handle and a clamping element for clamping one end of the mop on the lower end of the handle. A rod is slidable and turnable in the handle and projects from the same at both ends.

The Bakemeier Patent discloses a mop holder and wringer. It comprises a handle with a groove and a sleeve slidably mounted on the handle. The sleeve has a member travelling in the groove of the handle where the handle is caused to rotate by the travel of the member on the sleeve.

The Johnson Patent discloses a combined mop and wringer head. It comprises a tubular handle and a plunger which is slidably mounted in the handle.

The '977 Makar Patent discloses an automobile washing mop employing a twistable mop head.

The '369 Makar Patent discloses a self-wringing mop. It utilizes a bevel gear on a crankshaft for manual rotation.

The Aasland Patent discloses a self-wringing mop. It comprises a head which is attached to a handle and a mop holder for holding a mop unit with a crank carried by the head which can be turned for wringing the mop.

The Heinonen Patent discloses scrubbing means. It comprises a shaft with an outer tube and within this a movable inner shaft, the outer tube and the inner shaft being provided with fixing heads and a mop. The fixing head of the inner shaft comprises a seat unrotatable with reference to the shaft and opening in cup fashion in the direction of the fixing head. A locking body is locked within the seat by means of threads on the outside of the locking body and threads in the inner surface of the seat. The part of the locking body projecting from the seat constitutes a shoulder border spreading out to the sides and behind which the mop has been affixed with the aid of an annular tie member so that the mop threads run between the border and the seat when the tie has been wound around the locking body between the shoulder border and the seat.

Therefore, it is highly desirable to have a new and improved self-wringing mop which can overcome the shortcomings of the prior art self-wringing mops. It is desirable have an improved quick squeezing self-wringing mop where a spring-and-ratchet mechanism can be used to lock and unlock the wringer handle from rotation and can be quickly released by a press of a button. There is a significant need for an improved quick squeezing self-wringing mop which is easy to use, especially for elderly people without much strength and where the spring-and-ratchet mechanism maintains the rotational position of the wringer handle.

SUMMARY OF THE INVENTION

The present invention is a new and improved quick squeezing self-wringing mop. Specifically, an outer tubular member of the quick squeezing self-wringing mop is rotated such that the strands of the mop are squeezed dry. It comprises an outer tubular member, an inner shaft located within the outer tubular member and which is movable longitudinally to the inner shaft and rotatable, a locking body, a mop, a spring-and-ratchet mechanism, and a handle member.

The improvement of the present invention is the spring-and-ratchet mechanism. This spring-and-ratchet mechanism is used for locking the rotational motion of the outer tubular member. The spring-and-ratchet mechanism comprises a pawl which is pivotally mounted to the outer tubular member. The pawl is biased by a spring means such that its tip is engaged with one of the multiplicity of longitudinal ribs located on the inner shaft. The rotational motion of the outer tubular member is governed by the spring-and-ratchet mechanism. When the outer tubular member is rotated in its clockwise circular path, which squeezes the mop, the outer tubular member can stop at any position relative the inner shaft and permits the outer tubular member to be released, without causing the mop to unwind. A user can simply press the pawl against the spring to disengage it from the longitudinal ribs of the inner shaft to unlock the rotational movement of the outer tube member, thereby allowing the outer tubular member to automatically and rapidly spring back to its initial position and unwind the mop for use.

In prior art self-wringing mops, once the outer tubular member is released, the mop tends to unwind and returns to its initial position. In contrast, the outer tubular member of the present invention can be released at any time by a user without having the mop automatically unwind.

It has been discovered, according to the present invention, that by having a spring-and-ratchet mechanism incorporated with the improved quick squeezing self-wringing mop, it will allow the rotational movement of the outer tube member to be controlled by the spring-and-ratchet mechanism.

It has additionally been discovered, according to the present invention, that the outer tubular member of the improved quick squeezing self-wringing mop may be locked by a spring-and-ratchet mechanism. Therefore, a user can stop applying a rotational force to the outer tubular member at any given time, without causing the outer tube member to automatically spring back to its starting position. The spring-and-ratchet mechanism provides a lock for securing the outer tubular member from springing back to its starting position or it can be released to allow fast release movement of the outer tubular member.

It has further been discovered, according to the present invention, that a spring biased pawl may be pivotally mounted within the outer tubular member, such that the pivoted pawl is biased by a spring means to engage with one of the longitudinal ribs on the inner shaft of the quick squeezing self-wringing mop for locking the rotational movement of the outer tubular member. Therefore, a user may simply press the pawl against the spring means to disengage it from one of the longitudinal ribs of the inner shaft of the quick squeezing self-wringing mop to unlock the rotational movement of the outer tube member and allow the mop to unwind.

It is therefore an object of the present invention to provide an improved quick squeezing self-wringing mop, where the rotational motion of the outer tubular member is governed by a spring-and-ratchet mechanism, so that the user can stop applying a rotational force to the outer tubular member at any given time, without causing the outer tubular member to automatically rotate back to its initial position.

It is also an object of the present invention to provide an improved quick squeezing self-wringing mop, where the rotational motion of the outer tubular member is governed by a spring-and-ratchet mechanism. When the outer tubular member is rotated in its clockwise circular path, which squeezes the mop, the outer tubular member can stop at any position relative the inner shaft and the outer tubular member can be released without causing the mop to unwind.

It is an additional object of the present invention to provide an improved quick squeezing self-wringing mop, where the wringing action is activated by rotating the outer tubular member around the inner shaft of the mop.

It is a further object of the present invention to provide an improved quick squeezing self-wringing mop which comprises a spring biased pawl pivotally mounted within the outer tubular member, so that the pivoted pawl is biased by a spring means to engage with one of the longitudinal ribs on the inner shaft of the quick squeezing self-wringing mop for locking the rotational movement of the outer tubular member. Therefore, a user can simply press the pawl against the spring means to disengage it from the longitudinal ribs of the inner shaft of the quick squeezing self-wringing mop to unlock the rotational movement of the outer tube member and allow the mop to unwind for use.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a partial perspective view of the preferred embodiment of the present invention improved quick squeezing self-wringing mop, showing the components assembled together;

FIG. 2 is an enlarged top perspective view of the locking body of the present invention improved quick squeezing self-wringing mop;

FIG. 3 is an enlarged bottom perspective view of the locking body of the present invention improved quick squeezing self-wringing mop;

FIG. 4 is an enlarged cross-sectional view taken along line 4—4 of FIG. 1;

FIG. 5 is an enlarged perspective view of the pawl of the present invention improved quick squeezing self-wringing mop;

FIG. 6 is a front elevational view of the pawl of the present invention improved quick squeezing self-wringing mop;

FIG. 7 is a partial perspective view of the longitudinal elongated inner shaft of the present invention quick squeezing self-wringing mop, showing a multiplicity of longitudinal ribs; and FIG. 8 is a cross-sectional view taken along line 8—8 of FIG. 1.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 and 7, there is shown at 10 a partial perspective view of the present invention improved quick squeezing self-wringing mop. The self-wringing mop 10 comprises a longitudinal elongated hollow inner shaft 12, a cone shaped hollow locking body 14, a mop 16, an outer tubular member 18, a spring-and-ratchet mechanism 20, and a handle member 22. The inner shaft 12 has a proximal section 24 with a proximal end 26, a middle section 28, and a distal section 30 with a distal end 32. These sections of the inner shaft 12 can be made as a unitary component or they can be made as a three piece design which can be removably detachable from each other.

Referring to FIGS. 1, 2 and 3, there is shown at 14 the locking body of the present invention improved quick squeezing self-wringing mop 10. The locking body 14 has an upper cup member 34 and a lower stem 36 which is integrally attached the bottom end of the cup member 34. The upper cup member 34 has a cavity 40 wherein middle section 55 of the mop 16 is retained. The locking body 14 is assembled by inserting the lower stem 36 into the proximal end 26 of the inner shaft 12 and securing it to the inner shaft 12 by a pin fastener 38, as shown in FIG. 1.

Referring again to FIG. 1, the outer tubular member 18 is disposed around the proximal section 24 of the inner shaft 12 and movable longitudinally and rotatable with respect to the inner shaft 12. The outer tubular member 18 has a proximal section 42 with a large diameter proximal end 44 and a distal section 46 with a small diameter distal end 48. The proximal section 42 has a tapered outer surface 49 that increases in diameter in a direction towards the locking body 14. A multiplicity of spaced apart longitudinal ribs 50 are integrally connected the outer surface 49 of the proximal section 42 of the outer tubular member 18.

Referring to FIGS. 1, 2 and 3, the mop 16 comprises a multiplicity of longitudinal elongated strands 52. For clarity only, FIG. 1 illustrates one of the multiplicity of elongated strands 52 of the mop 16. Each strand 52 has a pair of opposite ends 54 and 56, and a middle section 55. A strap member 58 ties the middle sections 55 of the of the multiplicity of strands 52 by inserting one end of the strap member 58 through one of two holes 60 from the exterior side of the locking body 14 and then inserted back through the other hole 60 from the interior side of the locking body 14, thereby securing the strap member 58 to the lower stem 36 of the locking body 14, as shown in FIG. 1. A transverse rod 62 is also provided for retaining the middle sections 55 of the mop 16. The transverse rod 62 is inserted through and attached in a transverse direction on the locking body 14 such that the middle sections 55 of the multiplicity of strands 52 are retained within the cavity 40 of the cup member 34, thereby preventing the rotation of the mop 16.

It will be appreciated that the transverse rod 62 is not needed for retaining the middle sections 55 of the mop 16 because the strap member 58 is satisfactory for holding the middle sections 55 within the cup member 34.

Referring to FIG. 1, there is shown at 63 an annular tie member which is connected to the ends 54 and 56 of the multiplicity of strands 52 and disposed around the tapered outer surface 49 of the proximal section 42 of the outer tubular member 18. The large diameter proximal end 44 of the tubular member 18 has a greater diameter than the inner diameter of the annular tie member 63 to prevent displacement of the annular tie member 63 from the large diameter proximal end 44 of the tubular member 18 in the direction of the locking body 14. Both ends 54 and 56 of the multiplicity of strands 52 are held between the annular tie member 63 and the tapered outer surface 49 of the proximal section 42 of the tubular member 18. The longitudinal ribs 50 on the outer surface 49 prevent the rotation of the mop 16 with respect to the proximal section 42 of the tubular member 18.

Referring to FIG. 7, there is shown at 28 the middle-section of the inner shaft 12. The middle section 28 comprises a multiplicity of longitudinal ribs 64 which are approximately six (6) inches in length. The multiplicity of longitudinal ribs 64 of the middle section 28 are similar to a gear wheel and extend all around the middle section 28. The multiplicity of longitudinal ribs 64 are utilized for the spring-and-ratchet mechanism 20 shown in FIG. 4.

Referring to FIGS. 1, 4, 5 and 6, there is shown at 20 the spring-and-ratchet mechanism which comprises a spring biased pawl 65. The spring biased pawl 65 has a front curved shaped claw portion 69 and a hollow bottom portion 68. The spring biased pawl 65 is pivotally mounted in a side slot 67 on the distal section 46 of the outer tubular member 18 and retained by a roll pin 70. The pawl 65 is located adjacent to the distal end 48 and biased by a spring means 72 such that its tip 66 is engaged with one of the multiplicity of longitudinal ribs 64 on the middle section 28 of the inner shaft 12 to prevent the outer tubular member 18 from springing back to its initial position. The spring means 72 is mounted within the hollow bottom portion 68 of the pawl 65 and wrapped around the roll pin 70 for biasing the pawl 65. This spring-and-ratchet mechanism 20 is used for locking the rotational motion of the outer tubular member 18. The rotational motion of the outer tubular member 18 is governed by the spring-and-ratchet mechanism 20. When the outer tubular member 18 is rotated in its clockwise circular path, which squeezes the mop 16, the outer tubular member 18 can stop at any position relative to the inner shaft 12 and the outer tubular member 18 can be released without causing the mop 16 to unwind. Therefore, a user can simply press the pawl 65 against the spring means 72 to disengage it from the longitudinal ribs 64 on the middle section 28 of the inner shaft 12 to unlock the rotational movement of the outer tube member 18, thereby allowing the outer tubular member 18 to automatically and rapidly spring back to its initial position and unwind the mop for subsequent mopping use. In prior art self-wringing mops, once the outer tubular member is released, the mop tends to unwind and returns to its initial position. In contrast, the tubular member 18 of the present invention can be released by a user without having the mop 16 automatically unwind. The pawl 65 will hold the outer tubular member 18 at any given position and at such time can be released by the user. To unwind the mop 16, the user can simply press the pawl 65 against the spring means 72 to disengage it from the longitudinal ribs 64 of the inner shaft 12 to unlock the rotational movement of the outer tubular member 18 so that the mop 16 will unwind.

The outer tubular member 18 is normally rotated in the clockwise direction for wringing the mop dry. The outer tubular member 18 cannot rotate in the counterclockwise direction because of the spring-and-ratchet mechanism is a one-way ratchet mechanism which prevents this from occurring. When the pawl 65 is pressed, the outer tubular member 18 is released in the counterclockwise direction, which in turn unwinds the mop for use. The arrows in FIG. 4 illustrate the direction of the outer tubular member 18 must rotate to wring the mop 16.

Referring to FIGS. 1 and 8, there is shown at 22 the handle member of the present invention. The handle member 22 is generally a hollow cylindrical shaped body for gripping the self-wringing mop 10. The handle member 22 has a multiplicity of longitudinal inner ribs 74 protruding out from the interior surface of the hollow body of the handle member 22 for providing a press-fit engagement to the inner shaft 12. This unique feature of the handle member 22 does not require any fastening means for securing it to the inner shaft 12 of the quick squeezing self-wringing mop 10. A longitudinal finger grip 76 is also provided with the handle member 22 and is integrally attached to the exterior surface of the hollow body of the handle member 22. The handle member 22 further comprises means for snapping on the distal end 48 of the outer tubular member 18 such that the mop 16 is stored in a stretched position as shown in FIG. 1. The distal end 32 of the inner shaft 12 is provided with a cap member (not shown) which is utilized for hanging the self-wringing mop 10 in the vertical position.

The operation of the foregoing embodiment now will be described. When a user stops applying a rotational force to the outer tubular member 18 at any given time and releases the outer tubular member 18, the spring-and-ratchet mechanism 20 will lock the tubular member 18, and thereby not allow the mop 16 to unwind. When the pawl 65 is pressed against the spring means 72 to disengage it from the longitudinal ribs 64 of the inner shaft 12, thereby unlocks the rotational movement of the outer tubular member 18 and allows the mop 16 to unwind for use.

The mop 16 of the present invention is easy to replace when damaged or worn out. The present invention conforms to conventional forms of manufacture or any other conventional way known to one skilled in the art, and is of simple construction and is easy in maintenance and use.

It will be appreciated that the dimension of the longitudinal ribs 64 of the inner shaft 12 described above is merely one illustrative embodiment and can include many other comparable sets of dimensions.

Defined in detail, the present invention is a quick squeezing self-wringing mop, comprising: (a) a longitudinal elongated hollow inner shaft having a distal section with a distal end, a middle section and a proximal section with a proximal end; (b) a generally cone shaped hollow locking body having an upper cup and a lower stem integrally attached to a bottom end of the upper cup, where the lower stem is inserted and attached within said proximal end of said inner shaft; (c) a hollow cylindrical shaped outer tubular member disposed around said proximal section of said inner shaft and movable longitudinally and rotatable with respect to said inner shaft and having a distal section with a small diameter distal end and a proximal section with a large diameter proximal end, the proximal section having a tapered outer surface that increases in diameter in a direction towards said locking body; (d) a multiplicity of longitudinal ribs integrally connected on said outer surface of said proximal section of said outer tubular member; (e) a mop having a multiplicity of strands, each strand having a first end, a middle and a second end; (f) a strap member attached to said middle of said multiplicity of strands, the strap member being inserted through said lower stem of said locking body and secured thereto by a transverse rod such that said middle of said multiplicity of strands are retained within said upper cup of said locking body to prevent rotation of said mop; (g) an annular tie member connected to said first and second ends of said multiplicity of strands and disposed around said proximal section of said outer tubular member and located adjacent to said proximal end, said large diameter proximal end of said tubular member having a greater diameter than the inner diameter of the annular tie member to prevent displacement of the annular tie member from said large diameter proximal end of said tubular member in the direction of said locking body, said first and second ends of said multiplicity of strands being held between said annular tie member and said outer surface of said proximal section of said tubular member, and said ribs on said proximal section of said tubular member preventing rotation of said mop with respect to said proximal section of said tubular member; (h) a multiplicity of longitudinally ribs extending around said middle section of said inner shaft and being covered by said distal section of said outer tubular member; and (i) a spring biasing pawl pivotally mounted to said distal section of said outer tubular member and located adjacent to said distal end and biased by a spring means such that the tip of the pawl is engaged with a respective one of said multiplicity of longitudinal ribs at said middle section of said inner shaft to prevent said mop from unwinding; (j) whereby when a user stops applying a rotational force on said outer tubular member and releases said outer tubular member at any given time, the mop will not automatically unwind, and when said pawl is pressed against said spring means, said outer tubular member rotates back to its initial position, thereby allowing said mop to unwind for mopping use.

Defined broadly, the present invention is a self-wringing mop, comprising: (a) a longitudinal inner shaft having a distal section with a distal end, a middle section and a proximal section with a proximal end; (b) a locking body attached to said proximal end of said inner shaft; (c) an outer tubular member disposed around said proximal section of said inner shaft and movable longitudinally and rotatable with respect to said inner shaft and having a distal section with a distal end and a proximal section with a proximal end; (d) at least one longitudinal rib located on said proximal section of said outer tubular member; (e) a mop having a multiplicity of strands, each strand having a first end, a middle and a second end, where the middle of the multiplicity of strands are retained within said locking body to prevent rotation of the mop; (f) an annular tie member connected to said first and second ends of said multiplicity of strands and disposed around said proximal section of said outer tubular member and located adjacent to said proximal end, said proximal end of said tubular member having a greater diameter than the inner diameter of the annular tie member to prevent displacement of the annular tie member from said proximal end of said tubular member in the direction of said locking body, said first and second ends of said multiplicity of strands being held between the annular tie member and said proximal section of said tubular member, and said at least one longitudinal rib of said proximal section of said tubular member preventing rotation of said mop with respect to said proximal section of said tubular member; (g) at least two longitudinal ribs located on said middle section of said inner shaft and being covered by said distal section of said outer tubular member; and (h) a pawl pivotally mounted to said distal section of said outer tubular member and located adjacent to said distal end and biased by a spring means such that the tip of the pawl is engaged between said at least two longitudinal ribs on said middle section of said inner shaft to prevent said mop from unwinding; (i) whereby when a user stops applying a rotational force on said outer tubular member and releases said outer tubular member at any given time, the mop will not automatically unwind, and when said pawl is pressed against said spring means, said outer tubular member rotates back to its initial position, thereby allowing said mop to unwind for mopping use.

Defined more broadly, the present invention is a self-wringing mop, comprising: (a) a longitudinal inner shaft having at least two longitudinal ribs; (b) a tubular member disposed around said inner shaft and covering said least two longitudinal ribs and movable longitudinally and rotatable with respect to said inner shaft; (c) a locking body connected to one end said inner shaft; (d) a mop having a multiplicity of strands; (e) a tie member connected to ends of said multiplicity of strands and disposed around said tubular member and preventing rotation of said mop with respect to said tubular member, said tubular member having means for preventing displacement of the tie member from said tubular member in the direction of said locking body; and (f) a pawl pivotally mounted to said tubular member and biased by a spring means such the pawl is engaged between said at least two longitudinal ribs of said inner shaft to prevent said mop from unwinding; (g) whereby when a user stops applying a rotational force on said tubular member and releases said tubular member at any given time, the mop will not automatically unwind, and when said pawl is pressed against said spring means, said tubular member rotates back to its initial position, thereby allowing said mop to unwind for mopping use.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A quick squeezing self-wringing mop, comprising:

a. a longitudinal elongated hollow inner shaft having a distal section with a distal end, a middle section and a proximal section with a proximal end;

b. a generally cone shaped hollow locking body having an upper cup and a lower stem integrally attached to a bottom end of the upper cup, where the lower stem is inserted and attached within said proximal end of said inner shaft;

c. a hollow cylindrical shaped outer tubular member disposed around said proximal section of said inner shaft and movable longitudinally and rotatable with respect to said inner shaft and having a distal section with a small diameter distal end and a proximal section with a large diameter proximal end, the proximal section having a tapered outer surface that increases in diameter in a direction towards said locking body;

d. a multiplicity of longitudinal ribs integrally connected on said outer surface of said proximal section of said outer tubular member;

e. a mop having a multiplicity of strands, each strand having a first end, a middle and a second end;

f. a strap member attached to said middle of said multiplicity of strands, the strap member being inserted through said lower stem of said locking body and secured thereto by a transverse rod such that said middle of said multiplicity of strands are retained within said upper cup of said locking body to prevent rotation of said mop;

g. an annular tie member connected to said first and second ends of said multiplicity of strands and disposed around said proximal section of said outer tubular member and located adjacent to said proximal end, said large diameter proximal end of said tubular member having a greater diameter than the inner diameter of the annular tie member to prevent displacement of the annular tie member from said large diameter proximal end of said tubular member in the direction of said locking body, said first and second ends of said multiplicity of strands being held between said annular tie member and said outer surface of said proximal section of said tubular member, and said ribs on said proximal section of said tubular member preventing rotation of said mop with respect to said proximal section of said tubular member;

h. a multiplicity of longitudinal ribs extending around said middle section of said inner shaft and being covered by said distal section of said outer tubular member; and i. a spring biasing pawl pivotally mounted to said distal section of said outer tubular member and located adjacent to said distal end and biased by a spring means such that the tip of the pawl is engaged with a respective one of said multiplicity of longitudinal ribs at said middle section of said inner shaft to prevent said mop from unwinding;

j. whereby when a user stops applying a rotational force on said outer tubular member and releases said outer tubular member at any given time, the mop will not automatically unwind, and when said pawl is pressed against said spring means, said outer tubular member rotates back to its initial position, thereby allowing said mop to unwind for mopping use.

2. The quick squeezing self-wringing mop in accordance with claim 1 further comprising a hollow cylindrical shaped handle member for gripping said self-wringing mop and having a multiplicity of longitudinal inner ribs such that the handle member can be press-fitted onto said distal section of said inner shaft.

3. The quick squeezing self-wringing mop in accordance with claim 2 wherein said handle member further comprises a longitudinal finger grip protruding out from an exterior surface of said handle member for gripping said handle member.

4. The quick squeezing self-wringing mop in accordance with claim 2 wherein said handle member further comprises means for retaining said distal end of said outer tubular member such that said mop is stored in a stretched position.

5. The quick squeezing self-wringing mop in accordance with claim 1 wherein said spring biasing pawl is pivotally mounted to said distal section of said outer tubular member by a roll pin.

6. A self-wringing mop, comprising:

a. a longitudinal inner shaft having a distal section with a distal end, a middle section and a proximal section with a proximal end;

b. a locking body attached to said proximal end of said inner shaft;

c. an outer tubular member disposed around said proximal section of said inner shaft and movable longitudinally and rotatable with respect to said inner shaft and having a distal section with a distal end and a proximal section with a proximal end;

d. at least one longitudinal rib located on said proximal section of said outer tubular member;

e. a mop having a multiplicity of strands, each strand having a first end, a middle and a second end, where the middle of the multiplicity of strands are retained within said locking body to prevent rotation of the mop;

f. an annular tie member connected to said first and second ends of said multiplicity of strands and disposed around said proximal section of said outer tubular member and located adjacent to said proximal end, said proximal end of said tubular member having a greater diameter than the inner diameter of the annular tie member to prevent displacement of the annular tie member from said proximal end of said tubular member in the direction of said locking body, said first and second ends of said multiplicity of strands being held between the annular tie member and said proximal section of said tubular member, and said at least one longitudinal rib of said proximal section of said tubular member preventing rotation of said mop with respect to said proximal section of said tubular member;

g. at least two longitudinal ribs located on said middle section of said inner shaft and being covered by said distal section of said outer tubular member; and h. a pawl pivotally mounted to said distal section of said outer tubular member and located adjacent to said distal end and biased by a spring means such that the tip of the pawl is engaged between said at least two longitudinal ribs on said middle section of said inner shaft to prevent said mop from unwinding;

i. whereby when a user stops applying a rotational force on said outer tubular member and releases said outer tubular member at any given time, the mop will not automatically unwind, and when said pawl is pressed against said spring means, said outer tubular member rotates back to its initial position, thereby allowing said mop to unwind for mopping use.

7. The self-wringing mop in accordance with claim 6 further comprising a handle member for gripping said self-wringing mop and having at least one longitudinal inner rib, the handle member being securely press-fitted onto said distal section of said inner shaft.

8. The self-wringing mop in accordance with claim 7 wherein said handle member further comprises finger grips protruding out from an exterior surface of said handle member for gripping said handle member.

9. The self-wringing mop in accordance with claim 7 wherein said handle member further comprises means for retaining said distal end of said outer tubular member such that said mop is stored in a stretched position.

10. The self-wringing mop in accordance with claim 6 wherein said locking body further comprises an upper cup and a lower stem integrally attached to a bottom end of the upper cup, where said middle of said multiplicity of strands are retained within the upper cup of said locking body by a transverse rod such that said middle of said multiplicity of strands are prevented from rotating.

11. The self-wringing mop in accordance with claim 6 wherein said pawl is pivotally mounted to said tubular member by a roll pin.

12. A self-wringing mop, comprising:

a. a longitudinal inner shaft having at least two longitudinal ribs;

b. a tubular member disposed around said inner shaft and covering said least two longitudinal ribs and movable longitudinally and rotatable with respect to said inner shaft;

c. a locking body connected to one end said inner shaft;

d. a mop having a multiplicity of strands;

e. a tie member connected to ends of said multiplicity of strands and disposed around said tubular member and preventing rotation of said mop with respect to said tubular member, said tubular member having means for preventing displacement of the tie member from said tubular member in the direction of said locking body; and f. a pawl pivotally mounted to said tubular member and biased by a spring means such the pawl is engaged between said at least two longitudinal ribs of said inner shaft to prevent said mop from unwinding;

g. whereby when a user stops applying a rotational force on said tubular member and releases said tubular member at any given time, the mop will not automatically unwind, and when said pawl is pressed against said spring means, said tubular member rotates back to its initial position, thereby allowing said mop to unwind for mopping use.

13. The self-wringing mop in accordance with claim 12 further comprising a handle member for gripping said self-wringing mop and having at least one longitudinal inner rib, the handle member being securely press-fitted onto said inner shaft.

14. The self-wringing mop in accordance with claim 13 wherein said handle member further comprises finger grips protruding out from an exterior surface of said handle member for gripping said handle member.

15. The self-wringing mop in accordance with claim 13 wherein said handle member further comprises means for retaining said tubular member to said handle member such that said mop is stored in a stretched position.

16. The self-wringing mop in accordance with claim 12 wherein said locking body further comprises an upper cup and a lower stem integrally attached to a bottom end of the upper cup, where the middle of said multiplicity of strands are retained within the upper cup of said locking body by a transverse rod such that the middle of said multiplicity of strands are prevented from rotating.

17. The self-wringing mop in accordance with claim 12 wherein said pawl is pivotally mounted to said tubular member by a roll pin.

18. The self-wringing mop in accordance with claim 17 wherein said spring means is wrapped around said roll pin for biasing said pawl.

* * * * *